US006240604B1

(12) United States Patent
Fox

(10) Patent No.: US 6,240,604 B1
(45) Date of Patent: Jun. 5, 2001

(54) ZIPPER SLIDE HANDLE, TAB OR PULL APPARATUS

(76) Inventor: William Lester Fox, 1225 NW. 21st St., Apt. 3309, Stuart, FL (US) 34994

( * ) Notice: Subject to any disclaimer, the term of this patent is extended or adjusted under 35 U.S.C. 154(b) by 0 days.

(21) Appl. No.: 09/311,371

(22) Filed: May 13, 1999

(51) Int. Cl.[7] ..... A44B 19/26
(52) U.S. Cl. ..... 24/429
(58) Field of Search ..... 24/431, 430, 429, 24/598.5, 598.6, 551–553; 294/99.2; 606/206, 210

(56) References Cited

U.S. PATENT DOCUMENTS

| | | | |
|---|---|---|---|
| 581,250 | * | 4/1897 | McCawley . |
| 629,224 | * | 7/1899 | Watkins . |
| 1,892,678 | * | 1/1933 | McIntyre et al. . |
| 2,209,475 | * | 7/1940 | Rawlings . |
| 2,284,004 | * | 5/1942 | McCurdy . |
| 2,788,557 | * | 4/1957 | Garsson . |
| 3,545,049 | * | 12/1970 | Brueggeman . |
| 3,597,813 | * | 8/1971 | Takahashi . |
| 4,022,506 | | 5/1977 | Cloud, Sr. . |
| 4,334,809 | * | 6/1982 | Zavislake . |
| 4,512,064 | * | 4/1985 | Nishikawa . |
| 4,997,222 | | 3/1991 | Reed . |
| 5,044,482 | * | 9/1991 | Kramer . |
| 5,093,966 | | 3/1992 | Yaki . |
| 5,100,191 | | 3/1992 | Detrick . |
| 5,101,538 | | 4/1992 | Dieter . |
| 5,551,129 | | 9/1996 | Chu . |
| 5,621,954 | | 4/1997 | Miznno . |
| 5,979,021 | * | 11/1999 | Swift . |
| 6,035,497 | * | 3/2000 | Jackson . |

FOREIGN PATENT DOCUMENTS

| | | | | |
|---|---|---|---|---|
| 273689 | * | 2/1951 | (CH) | 24/429 |
| 283983 | * | 11/1952 | (CH) | 24/429 |

* cited by examiner

*Primary Examiner*—James R. Brittain
(74) *Attorney, Agent, or Firm*—Carl Fissell, Jr.

(57) ABSTRACT

A novel handle tab or pull for a zipper which comprises a unitary wire-like resilient member having an integral spring member and including a pair of offset, spring biased gripper members which are squeezed together against the tension of the integral spring member so as to separate the gripper members so that the ends of the gripper members may then be introduced into the slide tang or loop of the zipper after which the tension of the spring biased grippers is released causing the gripper members to lock around the tang or loop of the zipper securing the novel handle, tab or pull to the zipper enabling the zipper to be operated as originally manufactured. A cover member may be employed to increase handling area of the pull. The novel zipper handle, tab or pull may be used by the zipper user to replace a lost, destroyed or damage zipper handle, tab or pull.

10 Claims, 2 Drawing Sheets

ZIPPER SLIDE HANDLE, TAB OR PULL APPARATUS

BACKGROUND OF THE INVENTION

1. Field of the Invention

The present invention relates broadly to zippers. More particularly, this invention relates to zipper handles, tabs or pulls which are attached to the movable zipper slide employed to open and close a zipper. With still more specificity, this invention relates to a new, novel and heretofore unobvious apparatus which can be installed during the zipper manufacturing phase without tools and/or subsequently be used to replace a lost, destroyed or damaged zipper handle, tab or pull.

With still more specificity, this invention may include an optional cover device which can be installed over the novel handle, tab or pull for identification purposes and acts to prevent or avoid inadvertent or accidental loss of the novel handle, tab or pull from the zipper.

2. Description of the Prior Art

Zipper enclosure devices and apparatus are well known.

Zippers are and have been utilized as closure devices with everything wearable and most things carryable. Automobile convertible tops, riding boots, attaché cases, shower enclosures, curtains and almost anything which is fabricated in two pieces and which must be temporarily joined or closed and thereafter opened, can, and often do, employ a zipper or zippers.

The early zippers were not as popular as might be supposed for all their apparent ease and flexibility of use. The zipper has many inherent problems, not the least of which is the tendency to jam. Dirt, fabric, thread, etc., caught in the zipper teeth during opening or closing can cause the teeth of the zipper to jam so that the zipper cannot be further opened or closed until the offending object or objects are removed, assuming that this can be done.

Another problem is that of missing, lost or damaged zipper teeth. This renders the zipper useless and more often than not results in replacement of the complete zipper.

From the point of view of the consumer-user, probably the most frustrating zipper problem and the one that causes the most consternation and embarrassment is the loss of the zipper slide handle, tab or pull after the zipper has been opened on a garment being worn in a public place. It becomes quickly apparent to the garment wearer that there is no quick and easy way to close the zipper with the handle, tab or pull missing from the garment.

Obviously, it is possible to loop a short length of material through the zipper slide tang or loop, assuming of course that one is carrying a length of string or other material on their person, which is highly unlikely. Even a paper clip can be bent open and looped through the zipper slide tang to substitute for the missing zipper handle, tab or pull. However, most individuals do not carry paper clips with them for just such situations or events. The zipper owner is thus left with his or her embarrassment and anger over the inability to resolve the problem and close the zipper.

Zipper manufacturers, unlike shirt makers who supply extra buttons on shirts, do not supply extra zipper handles, tab or pulls with each zipper.

A review of the known zipper prior art has failed to disclose any reference to any easily available methods or means for replacing or attaching a replaceable handle, tab or pull in place of a lost, destroyed or damaged zipper handle, tab or pull. Hundreds of patents show and describe various handle, tab or pull constructions and most also describe attachment tools and procedures for securing the handles, tab or pulls to the zipper. However, in each instance, the known patent describes a construction which requires that the handle, tab or pull be attached by mechanical means and may also involve a forming operation. No known patent art describes a replaceable handle, tab, or pull, nor the attachment of a handle, tab or pull solely by hand and without the use of machines or other tools.

U.S. Pat. Nos. 5,626,093; 5,621,954; 4,022,506; and 5,101,538, listed herein by way of example only and not by way of limitation, all describe and illustrate examples of zipper handles, tabs or pulls for opening and closing typical zippers. However, none of these patents, taken either singly or in combination, show or describe, or for that matter even suggest, means for providing an easily attached, without tools, replaceable handle, tab or pull for a handle, tab or pull which has been destroyed, lost or damaged.

SUMMARY OF THE INVENTION

No known prior art describing zippers with attached handles, tabs or pulls relates to or describes a means or method for toollessly, quickly, easily and simply replacing a lost, damaged or destroyed zipper slide handle, tab or pull without the employment of forming machines or other tools and mechanical devices Also, no known prior art teaches the attachment of a replaceable handle, tab or pull without the complete removal of the garment carrying the zipper from the person of the wearer.

It is an important object therefore of the present invention to provide an easily attached replaceable zipper handle, tab or pull for a lost, damaged or destroyed handle, tab or pull.

Another important object of this invention is to provide an easily attachable replaceable handle, tab or pull for a zipper which is small in size and easily attached to the zipper by hand without tools or machines.

Still another object of this invention is to provide a relatively inexpensive, easily attached replaceable handle, tab or pull for a zipper which can be carried in a pocket or purse.

It is another important object of this invention to provide an easily attached replaceable handle, tab or pull for a zipper which is small enough to be unobtrusive yet sufficiently large so as to be handled easily and efficiently.

It is a still further object of the invention to provide a cover means for the zipper handle, tab or pull which is easily secured to the handle, tab or pull and which provides additional grasping surface for the zipper user.

Another important object of the invention is to provide a means to incorporate identification of manufacturer and/or user.

It is also an object of the invention to provide a means to securely lock the handle, tab or pull against accidental dislodgement or removal from the zipper slide.

These and other objects and advantages of the present invention are achieved by providing an open loop, single strand, of formable, semi-rigid, resilient material which is bent or formed intermediate its ends to provide a partial or multiple turn spring loop portion integral with the strand such that the two free ends of the strand extend away from the spring loop in separated relation to one another. The two separated ends are crossed over one another intermediate the ends to provide two additional members or legs extending away from the crossover. The two additional members are terminated in separate, orthogonal, inwardly bent or turned elements providing confronting, hook-like gripper members or fingers. Compression of the two separated members against the tension of the spring loop portion separates the two parallel members and the two hook-like members adjacent the slide tang or loop of the zipper. Release of the spring tension causes the gripper members to enter the slide tang or loop effectively securing the replaceable handle, tab or pull to the zipper slide. The zipper can now be opened or closed at will, as before the loss of the original factory installed original zipper handle, tab or pull.

Other objects, features and advantages of the present invention will be readily apparent from the following detailed description when considered in light of the accompanying drawings which illustrate by way of example only and not limitation, the principles of the invention and preferred modes of applying these principles.

DESCRIPTION OF A PREFERRED EMBODIMENT OF THE PRESENT INVENTION

Description of the Prior Zzipper Art

Figure 1:
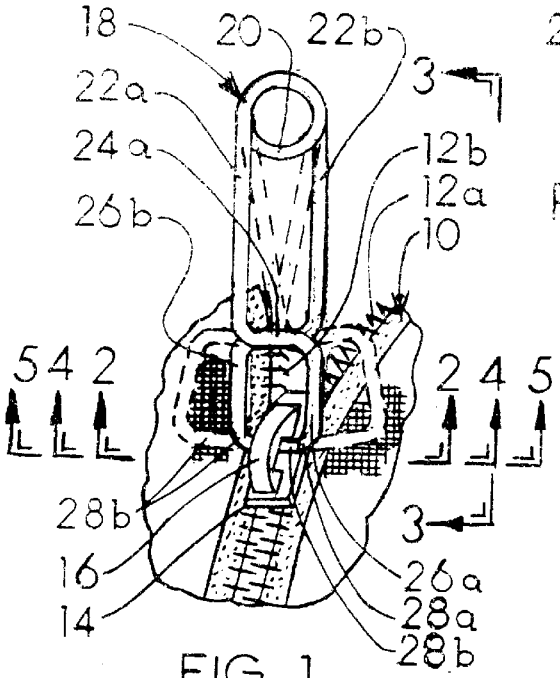
FIG. 1 is a top plan view of an attached apparatus embodying the present invention in full line and an unattached apparatus embodying the invention in dotted outline.
Figure 2:
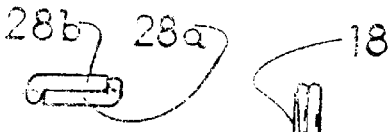
FIG. 2 is a detail end view taken along the line 2—2 of FIG. 1 of the present inventive apparatus, illustrating the nested construction of the forward ends of the two parallel members of the invention.

Conventional zippers all include at least two rows of interengagable members or teeth which must be joined together so as to cause the zipper to open and close. A slidable member or slide surrounds the rows of teeth and is normally movable back and forth along the toothed rows causing the teeth to intermesh or interengage opening and closing the zipper.

The exposed upper surface of the zipper slide is generally provided with an upstanding tang or loop which may be varied in size and shape depending upon the ultimate use to which the slide tang or loop is to be put.

In order to cause the slide to move back and forth along the rows of teeth, a handle, tab or pull (hereinafter referred to as a pull) is provided and includes an end portion which may be machine formed onto the slide. Either the tang or loop is bent around an end hole on the pull or the pull may be attached to the tang or loop in a forming operation to close the open end of the pull into the tang or loop. Other mechanical means of assembly may be employed but most require staking or other types of forming operations.

In either case the pull is adapted to hang loosely on the zipper tang or loop so as to lie flat against the slide when not being used to open or close the zipper.

The portion of the pull engaging the loop or tang is of necessity fairly small and relatively thin in cross section so as to be easily movable and so as to lie flat against the rows of teeth. Due to the light weight construction and small attachment area in use, the stress load and wear on the pull is concentrated in the small area at the end of the pull around the attachment hole in the pull. This concentrated stress load and wear is greatly increased when the user is confronted with a temporary or repeated zipper teeth jamming problem or condition. Eventually this excessive wear leads to the attachment area breaking down and ultimately to the loss of the pull, or to the jamming of the zipper. Most often actual loss of the zipper pull is the usual result.

At this juncture the zipper is useless since it cannot be opened or closed. The zipper wearer or user is left in an embarrassing predicament with an open or closed zipper in clothing or other utility item with no readily available means to extricate him or herself. Loss of the zipper pull usually results in replacement of the complete zipper. Even assuming reacquisition of the lost pull, there is no readily available means to reapply the broken off pull to the zipper slide tang or loop. The wear on the pull has removed any available attachment area. Consequently, without mechanical assistance or tools, the zipper owner is out of luck and the zipper is inoperable. Obviously, this situation may be somewhat less stressful for the user when the zipper pull is broken away from the slide of a non garment application or from outer wear items.

The present invention solves these and other similar problems in a new, novel and heretofore unobvious manner by providing an easily carried and attachable replaceable zipper slide pull to replace a lost, destroyed or damaged pull with only the human hand and fingers.

Detailed Description of the Invention

The construction, formation and operation of the novel apparatus embodying the present invention is made readily apparent from a review of the accompanying drawings when taken in conjunction with the accompanying specification and claims.

A conventional zipper 10 is seen in FIG. 1 of the drawings to include two rows of interengagable members or teeth 12*a* 12*b*, which, as earlier described herein, must be joined together so as to close or open the zipper. A slidable member or slide 14 is arranged to surround the rows of teeth 12*a* and 12*b* and to be movable back and forth therealong so as to engage the teeth and close or to disengage the teeth to open the zipper.

The exposed upper surface of the slide 14 includes an upstanding tang or loop 16. To move the slide back and forth along the teeth the novel replaceable pull 18 of the present invention is loosely, hingedly secured to the tang or loop 16 and is articulately movable back and forth on the tang or loop 16 to further facilitate the forward and backward movement of the slide 14 along the teeth of the zipper.

The novel zipper pull 18 of the present invention, which may be easily replaceable, as before mentioned, is illustrated in FIG. 1 of the drawings. As shown, the novel pull 18 comprises a single, unitary length of elongated, resilient formable material, such for example, as stainless steel wire. The pull 18 could also be fabricated from plastic or composite, i.e., carbon and/or glass material etc., having the requisite deflection and strength characteristics and capabilities, and being capable of accepting and enduring extreme bending and twisting. Assuming that a desired plastic material has the springiness, deflection and strength required, such material could be substituted for formed and bent steel wire.

The elongate wire member pull 18 (FIG. 1) is first formed circularly to provide a coiled spring 20 of partial or multiple turns integral with one end thereof. Two projecting members 22*a* and 22*b* resulting from the forming operation now extend in separated relation outwardly from the spring coil 20. The ends of the members 22*a* and 22*b* are next each bent at right angles so as to extend leftwardly and rightwardly in opposite directions away from one another, as indicated at 24*a* and 24*b*. Since member 24*a* is illustrated in front of the member 24*b*, the member 24*b* is not seen in FIG. 1 but can be clearly seen in FIGS. 3 and 5, still to be described.

The members or extensions 24*a* and 24*b* are now bent downwardly at approximately right angles. However, viewed in another plane (see FIG. 3), member 24*a* is bent slightly to the right to form extension 26*a* while member 24*b* is bent slightly to the left to form extension 26*b*, the construction of the two members thus forming the appearance of an "X" configuration between the members separated from one another, as in FIG. 3.

The downwardly extended ends of members 26*a* and 26*b* (FIG. 1) are now bent inwardly in opposite directions to provide two opposed, adjacent and parallel hook-like gripper members or fingers 28*a* and 28*b*. The latter members are shown in FIG. 1 in a force applied application position in dotted outline and in a free closed position by solid line outline.

Figure 5:
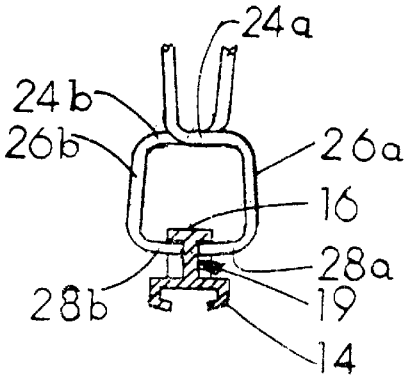
FIG. 5 is a detail view taken along the line 5—5 of FIG. 1 showing the zipper handle, tab or pull engaging a zipper tang having a central web or pillar.

The purpose of the "X" configuration of members 26*a* and 26*b* (FIG. 3) and members 28*a* and 28*b* is to prevent separation of member 28*a* from member 28*b* when members 28*a* and 28*b* are in their free but intended working or closed position (or in a partially closed position as seen in FIG. 5). This same rationale is applicable to members 32*a* and 32*b* of the alternate construction employing slightly more than one full enlarged coil and wherein members 32*a* and 32*b* are bent downwardly to form members 26*a* and 26*b*. Members 28*a* and 28*b* can only be separated when their ends are open and free, one from the other. The open position is only a temporary one when the two grippers are ready to be installed within the tang or loop 16 of the slide 14. This locking feature of the invention to prevent opening or separating assures that both members 28*a* and 28*b* will transfer applied pull forces, in any direction, to the zipper slide 14 in unison to move the zipper slide 14 to open or close the zipper.

Figure 4:
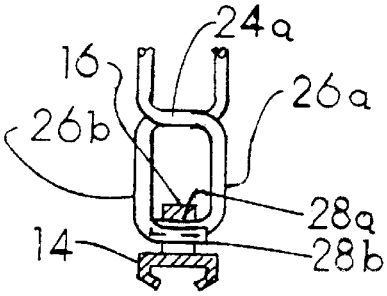
FIG. 4 is a detail view taken along the line 4—4 of FIG. 1 showing the zipper slide handle, tab or pull of the invention extended into and through the open tang or loop of the zipper slide.

FIGS. 4 and 5 are illustrative of two different zipper slide tang or loop attachment configurations which can be encountered and for which the present novel replaceable pull 18 is both useful and important as well as easily attachable, as earlier described.

Figure 6:
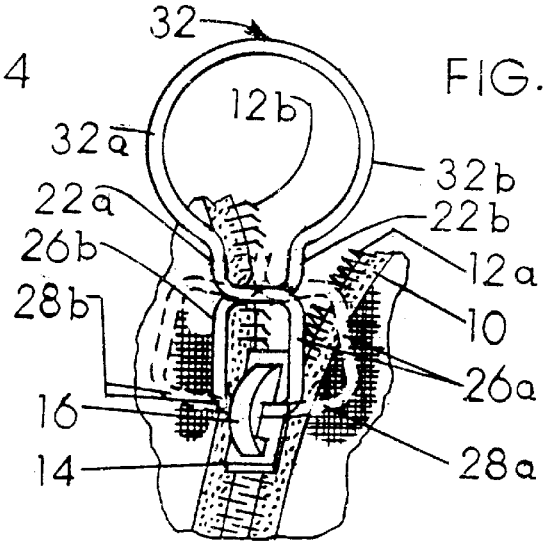
FIG. 6 is a top plan view of a modified form of the invention of FIG. 1 in which the unattached position is illustrated in dotted outline and the attached position is shown in full line.

In the detail view of FIGS. 4 and 6, the tang 16 of the slide 14 is seen as a loop. The two gripper members 28*a* and 28*b* are shown passing into and through the loop 16 with their respective end portions overlapped slightly within the confines of the loop 16 proper. This structural arrangement provides a relatively high degree of strength and leverage as a result of the use of two members instead of only one, and the fact that the members are round without sharp edges reduces the wear and distributes the loading force exerted by the pull 18 on the tang loop 16 during opening and closing of the zipper.

In FIG. 5 the gripper members 28*a* and 28*b* are disposed in abutting relationship against opposite sides of a rigid central pillar or post 19. It should be clear from the forgoing that the structural arrangements of FIGS. 1, 4 and 5 permit the present invention to be employed with most if not all of the known zipper tang or loop constructions.

As shown in FIG. 6 the downwardly separated members 22*a* and 22*b* are formed from partial spring coil members 32*a* and 32*b* of pull 32. Pull 18 consisting of more than one coil 20 (FIG. 1) is replaced by pull 32 comprised of partial coil 32*a* and 32*b* of FIG. 6. Otherwise the remaining structural configuration is essentially the same as in FIG. 1, with the noted and illustrated differences.

The earlier described "X" configuration is maintained in FIG. 6 as before but with the alternate enlarged partial coil loop 32, 32*a* and 32*b*. The loop ends are bent downwardly to form members 22*a* and 22*b* and thereafter the construction is substantially identical to that in FIG. 1, terminating in two opposed adjacent and parallel gripper members 28*a* and 28*b*.

Figure 3:
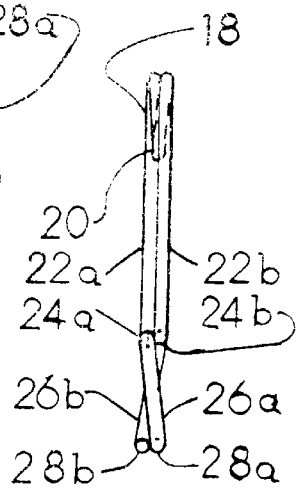
FIG. 3 is a side elevational view taken along the line 3—3 of the apparatus of FIG. 1.

An alternative construction to that just described would provide a larger loop than that illustrated in FIG. 6 which would be tangent to members 24*a* and 24*b*, as shown in FIGS. 1, 3 and 4, and may be slightly more than one full coil so as to extend beyond the centers of 24*a* and 24*b* and would overlap as a result of the larger coil. The coil ends would replace and serve the same functional purpose as members 24*a* and 24*b*. This arrangement would permit bending directly from the enlarged coil thus directly forming members 26*a* and 26*b* and thereafter members 28*a* and 28*b*. This alternate construction would maintain the "X" configuration as before to maintain the members in a tightly closed condition.

FIGS. 7–15 illustrate, in more detail, optional cover structures configured for use with the various forms of the novel pull 18 of the present invention. Convenience, ease of use and simplicity of manufacture and assembly combine to produce a relatively compact and simple construction, as will now be described.

Figure 7:
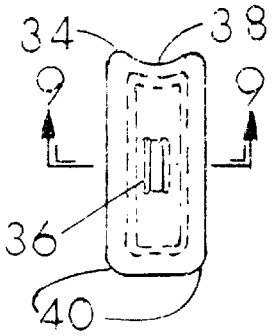
FIG. 7 is a top plan view of an optional top and bottom cover, both being separate but identical members which are snapped together to form a full cover adapted to fit between the two separated but parallel members, as in this view, but still exposing the handle, tab or pull.
Figure 8:
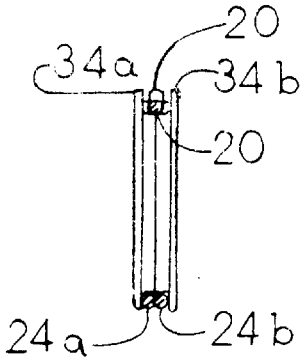
FIG. 8 is an edge view of the inventive apparatus of FIG. 7.
Figure 9:
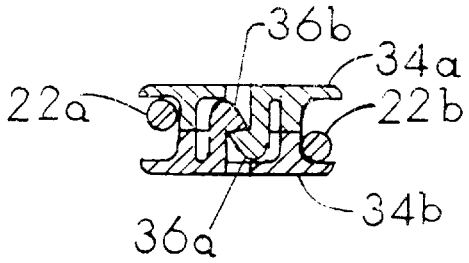
FIG. 9 is a view taken along the line 9—9 of FIG. 7 of the cover member illustrating the cover member as two identical members snapped together.

In FIGS. 7, 8 and 9, for example, a two piece cover structure 34 is shown comprising two identical parts 34*a* and 34*b*, (FIGS. 8 and 9). The two pieces may be fabricated of plastic for lightness and durability. Each identical member 34*a* and 34*b* includes one or more upstanding rigid, but slightly flexible, supports or pillars 36 and centrally disposed, snap locking ramp bars or projections 36*a* and

36*b*. The two parts 34*a* and 34*b* form the cover assembly 34 which is assembled between coil 20 and members 24*a* and 24*b* and members 22*a* and 22*b* of pull 18, (FIG. 1) by forcing the snap locking ramp bars 36*a* and 36*b* together causing the ramp bars to deflect and snap into locking position as seen in FIG. 9. This movement holds the two parts in a sandwich configuration as shown clearly in FIG. 8 of the drawing. One end of each member 34*a* and 34*b* is inwardly curved or rounded as at 38 while the opposite ends are simply rounded off as at 40.

By introducing the two cover members between the two separated, (but parallel in this view) members 22*a* and 22*b*, the separated and parallel members are securely and positively separated, thereby avoiding accidental or other displacement of the pull 18 from the zipper slide 14 of the zipper 10. Additionally, the flat surfaces provided by the cover member makes the pull 18 easier to handle during opening and closing of the zipper as well as providing surfaces for application of manufacturer logos, trademarks, advertisements, etc.

Figure 10:
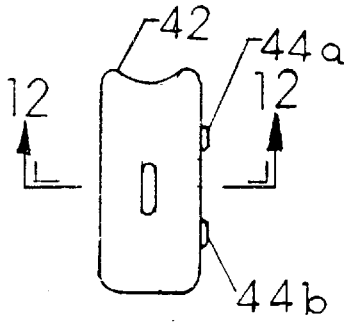
FIG. 10 is a view similar to FIG. 7 illustrating a single piece cover similar to that in FIG. 7 but incorporating an integral hinge or hinges in the cover construction.
Figure 11:
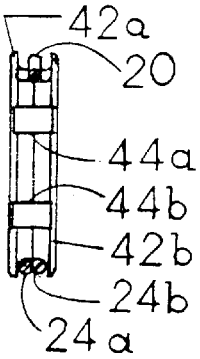
FIG. 11 is an edge view of the inventive apparatus of FIG. 10.
Figure 12:
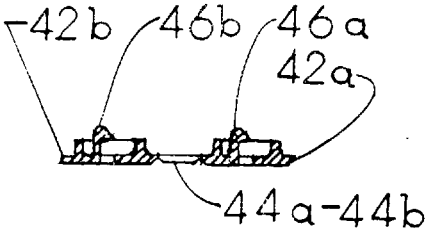
FIG. 12 is a view taken along the line 12—12 of FIG. 10 showing the cover unfolded as a single part.

The cover assembly of FIGS. 10, 11 and 12 is a variation of the construction illustrated in FIGS. 7, 8 and 9. This cover variation is illustrated as a one piece arrangement wherein identical parts 42*a* and 42*b* (being the same as parts 34*a* and 34*b*, FIG. 1) are joined to one another by means of one or more spacer hinge bars 44*a* and 44*b*, including bendable portions therebetween. Two snap locking ramp bars 46*a* and 46*b* (FIG. 12) are molded with the one piece hinged cover member 42, including the members 42*a* and 42*b*, FIGS. 10, 11 and 12. engagement with each other securing the two cover parts 42*a* and 42 over the zipper pull 18 as a unitary assembly.

Figures 13, 14:
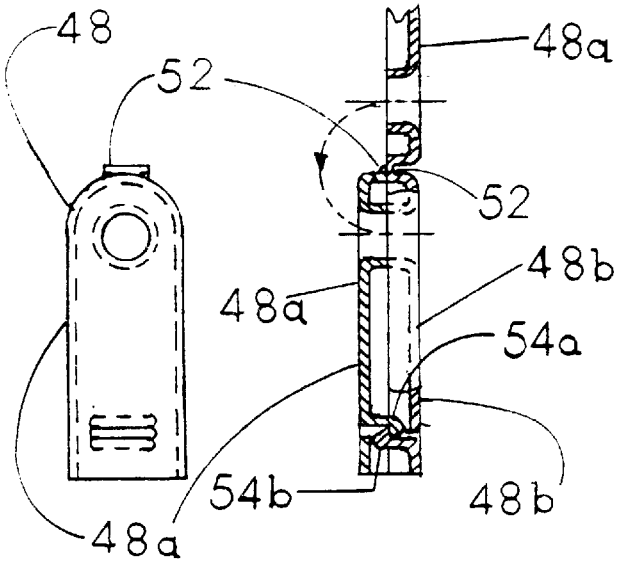
FIG. 13 is a plan view of a further inventive modification of the cover apparatus of FIGS. 7 and 10 which is intended to cover the exterior of the handle, tab or pull.
FIG. 14 is an edge view of the cover member of FIG. 13.
Figure 15:
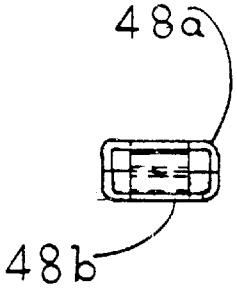
FIG. 15 is a bottom view of the inventive apparatus of FIG. 13.

The structural configuration of FIGS. 13, 14 and 15 illustrate a still further arrangement in which the pull 18 is, almost, but not completely enclosed by the cover member 48. Depending on fabrication choice, among other things, the pull cover 48 may comprise two single members 48*a* and 48*b*, or, if desired, the cover 48 may comprise a single structural member (48*a* and 48*b*) provided with a hinge 52. The end of each cover member 48*a* and 48*b* opposite the hinge 52 includes individual ramp bar projections 54*a* and 54*b*, as seen in FIG. 14. This structural arrangement permits the two cover members 48*a* and 48*b* to be folded in half around the pull 18. In either case the cover assembly 48 is assembled over the novel pull 18 and snapped together so as to fully enclose the pull 18 except for the members 26*a* and 26*b* and the gripper members 26*a* and 28*b*.

The diameter or thickness of the wire strand 18 will, among other things, determine just how difficult or how easy it will be for the individual to compress the parallel members 22*a* and 22*b* and thus how simple and easy or difficult it will be to attach the novel replacement pull 18 to the zipper 10. FIG. 3 illustrates how the cross over portion of the apparatus is bent and shaped so that the two leg members 22*a* and 22*b* can lie flat closely abutting one another.

It is noted in connection with FIGS. 7 and 13 that a supporting rib (not otherwise identified) and illustrated in dotted outline, may be incorporated in the cover construction. The external perimeter rib or pillars are considered essential to structural viability of the assembly and act as spacers to facilitate the locking features of members 54*a* and 54*b*. The others act as separators between members 22*a* and 22*b* of pull 18 (FIG. 1).

As earlier mentioned herein, the present novel invention provides an apparatus which is constructed of a size to be unobtrusive and not likely to be noticed. A packet of two or three replacement pulls 18 can easily be carried on or about the person with little or no noticeable bulk or notice.

There has thus been described a new, novel and heretofore unobvious zipper handle, tab or pull for use on zippers which can be employed to replace a lost, damaged or destroyed zipper pull. The novel pull herein described is a simple, unitary device or apparatus which is structurally fabricated and mechanically arranged such that the only tool required to install the zipper pull onto a zipper slide or to replace a lost, damaged or destroyed zipper pull is the human hand. The replacement pull is small enough to be carried in a pocket or purse without drawing undue attention, thus eliminating the embarrassment of an inoperable zipper.

What is claimed is:

1. Apparatus providing a novel handle, tab or pull for attachment to the slide tang of a zipper comprising, oppositely disposed formable members extending into a formation in which the formable members are crossed over one another so as to extend in a symmetric disposition in two different planes offset from one another, the extending ends being shaped to provide oppositely disposed finger members for engaging and gripping the slide tang, and spring means operably associated with said formable members for opening and closing said finger members to allow said finger members to be attached and fixedly secured to said zipper slide tang upon application of pressure to said spring means to open said finger members against the pressure of said spring means so as to cause said finger members to enter into the slide tang from opposite sides upon release of the applied pressure to said spring means, and including cover members for disposition between said finger members so as to maintain spacing between these finger members.

2. The invention in accordance with claim 1 wherein said apparatus is formed of round or other similar stock without sharp edges and wherein the stress points and load forces of the pull are distributed with respect to said slide tang and said pull so as to avoid excessive wear on said pull and said tang.

3. The invention in accordance with claim 1 wherein said apparatus is formed of spring material.

4. The invention in accordance with claim 3 wherein said spring material is stainless steel.

5. The invention in accordance with claim 3 wherein said spring material is plastic.

6. The invention in accordance with claim 3, wherein said spring material is plastic composite.

7. The invention in accordance with claim 1 wherein each finger member is offset from the plane of its opposite member effectively preventing separation of said finger members such that the two members act in unison.

8. The invention in accordance with claim 1, wherein said finger members are forced by the cross over configuration into side by side relationship when the spring means is relaxed in the desired installed position.

9. Apparatus providing a novel handle, tab or pull for attachment to the slide tang of a zipper comprising, oppositely disposed formable members extending into a formation in which the formable members are crossed over one another so as to extend in a symmetric disposition in two different planes offset from one another, the extending ends being shaped to provide oppositely disposed finger members for engaging and gripping the slide tang, and spring means operably associated with said formable members for opening and closing said finger members to allow said finger members to be attached and fixedly secured to said zipper slide tang upon application of pressure to said spring means so as to cause said finger members to enter into the slide tang from opposite sides upon release of the applied pressure to said spring means, and wherein the apparatus includes two cover members comprising two identical parts having a hinge disposed there between and including means enabling the two parts to be snapped together when the two parts are folded together at the hinge one upon the other.

10. Apparatus providing a novel handle, tab or pull for attachment to the slide tang of a zipper comprising, oppositely disposed formable members extending into a formation in which the formable members are crossed over one another so as to extend in a symmetric disposition in two different planes offset from one another the extending ends being shaped to provide oppositely disposed finger members for engaging and gripping the slide tang, and spring means operably associated with said members for opening and closing said finger members to allow said finger members to be attached and fixedly secured to said zipper slide tang upon application of pressure to said spring means to open said finger members against the pressure of said spring means so as to cause said finger members to enter into the slide from opposite sides upon release of the applied pressure to said spring means, and wherein the apparatus includes a cover member comprising two parts wherein the two parts of the cover member include opposite mirror image interengagable members permitting said parts to interfit with one another providing a flat sandwich construction.

* * * * *